US005101795A

United States Patent [19]

Hirschmann et al.

[11] Patent Number: 5,101,795

[45] Date of Patent: Apr. 7, 1992

[54] FUEL INJECTION SYSTEM FOR AN INTERNAL COMBUSTION ENGINE, HAVING COMPENSATION FOR CHANGING DYNAMIC OPERATING CONDITIONS

[75] Inventors: Klaus Hirschmann, Leonberg; Erich Junginger, Stuttgart; Eberhard Schnaibel, Hemmingen, all of Fed. Rep. of Germany

[73] Assignee: Robert Bosch GmbH, Stuttgart, Fed. Rep. of Germany

[21] Appl. No.: 549,012

[22] PCT Filed: Mar. 17, 1988

[86] PCT No.: PCT/EP88/00214

§ 371 Date: Sep. 17, 1990

§ 102(e) Date: Sep. 17, 1990

[87] PCT Pub. No.: WO89/08775

PCT Pub. Date: Sep. 21, 1989

[51] Int. Cl.[5] ..... F02D 41/10

[52] U.S. Cl. ..... 123/488; 123/492; 123/493

[58] Field of Search ..... 123/488, 492, 493

[56] References Cited

U.S. PATENT DOCUMENTS

| | | | |
|---|---|---|---|
| 4,411,235 | 10/1983 | Shinoda et al. | 123/488 |
| 4,534,331 | 8/1985 | van Belzen et al. | 123/492 |
| 4,643,152 | 2/1987 | Yamato | 123/493 |
| 4,747,387 | 5/1988 | Takao et al. | 123/488 |

FOREIGN PATENT DOCUMENTS

| | | |
|---|---|---|
| 0162469 | 11/1985 | European Pat. Off. . |
| 0259544 | 3/1988 | European Pat. Off. . |

*Primary Examiner*—Andrew M. Dolinar
*Attorney, Agent, or Firm*—Walter Ottesen

[57] ABSTRACT

A fuel injection system for an internal combustion engine of the type wherein the lengths of fuel injection pulses ($t_i$) are based on engine load signals (TL) developed from a measurement of intake manifold pressure (p) and wherein compensation is provided for the fuel injection signals during transitions between different dynamic operating conditions. Transition compensation for the inlet manifold pressure values representative of engine load is achieved by modifying the pressure values in dependence upon incremental pressure differences (Δp). The pressure difference values (Δp) used for this purpose can themselves be modified by other engine-dependent factors ($F_1$, $F_2$) when the measured incremental manifold pressure differences (Δp) exceed predetermined thresholds.

7 Claims, 3 Drawing Sheets

FUEL INJECTION SYSTEM FOR AN INTERNAL COMBUSTION ENGINE, HAVING COMPENSATION FOR CHANGING DYNAMIC OPERATING CONDITIONS

FIELD OF THE INVENTION

The present invention relates to fuel injection systems for internal combustion engines of the type wherein the lengths of fuel injection pulses are based on engine load signals developed from a measurement of intake manifold pressure and wherein compensation is provided for the fuel injection signals during transitions between different dynamic operating conditions such as during acceleration or deceleration.

BACKGROUND OF THE INVENTION

It is known from U.S. Pat. No. 4,534,331 to determine when acceleration enrichment of the engine mixture is appropriate by sequential detection of engine inlet manifold pressure values (representing engine load values) having a predetermined characteristic. For example, acceleration enrichment could be provided when a predetermined number of sequential load values ascended in magnitude according to a specific relationship.

One important condition for the effectiveness of transition compensation during acceleration (or deceleration) is the actuality of the load information which is used to calculate the duration of injection. In a pressure system, the average pressure in the inlet manifold of the engine can, in a static case, be used to calculate load. Thus, in incremental systems, the average pressure is determined, for example by double sensing (at 180° intervals), whereas in segmental systems the average pressure can be obtained by high-frequency integration of pressure over one suction period.

Published European patent publications 0,259,544 and 0,162,469 disclose an acceleration correction of the injection amount, based on the measured pressure in the intake and in dependence on detected intake pressure differences. The correction is an additive one and further dependent on engine parameters, for example, temperature.

SUMMARY OF THE INVENTION

It is an object of the present invention to provide an improved means for obtaining compensation during transition conditions.

In accordance with the present invention, this object is achieved in that inlet manifold pressure values representative of engine load are modified to provide fast acting transition compensation in dependence upon incremental pressure difference values.

This measure has the advantage that it acts equally appropriately both during acceleration enrichment and during leaning out of the fuel air mixture on deceleration.

Advantageously, the pressure difference values are themselves modified by other engine-dependent factors when the measured incremental inlet manifold pressure differences exceed predetermined thresholds.

In a preferred embodiment, above a first threshold of pressure difference, the pressure value representative of engine load is modified additively in accordance with the pressure difference, itself modified by a first engine temperature dependent factor and, above a second threshold of pressure difference, the pressure difference is modified by a second, larger engine temperature-dependent factor.

The aforegoing measures provide transition compensation with a fast-acting response. In addition, slow-acting compensation can be provided by modifying the pressure values slowly in accordance with the running summation of the pressure difference values regulated with a slow time constant.

A further advantage is provided when both the average value of the inlet manifold pressure and the rectified peak value of the inlet manifold pressure over a complete combustion period are established, and wherein, when the peak value exceeds the average value by more than a predetermined threshold, the average value is replaced by the peak value to provide said pressure values modified in dependence upon the incremental pressure difference values to provide transition compensation.

BRIEF DESCRIPTION OF THE DRAWINGS

The invention is described further hereinafter, by way of example only, with reference to the accompanying drawings, in which.

DESCRIPTION OF THE PREFERRED EMBODIMENTS OF THE INVENTION

The operation of the present system is based on the theoretical assumption that, whenever there is a change of engine load from a first operating point to a second operating point, a certain excess or reduced quantity is required in order to obtain a new equilibrium between the film of fuel on the wall in the intake manifold and the fuel/air mixture contained within the manifold. Particularly in the case of so-called "wet" intake manifold (single point) injection, the wall film quantity is known to play a decisive part in the determination of the "correct" fuel quantity which needs to be present in the manifold to obtain the required lean-burn mixture.

In the most general form, this connection can be described by means of a characteristic field, in which the wall film quantity is plotted against engine load and engine rotational speed. In the event of a change in the operating point caused by a change in load and speed, the fuel quantity which must either be additionally added or held back can be obtained from the characteristic field.

Figure 5:
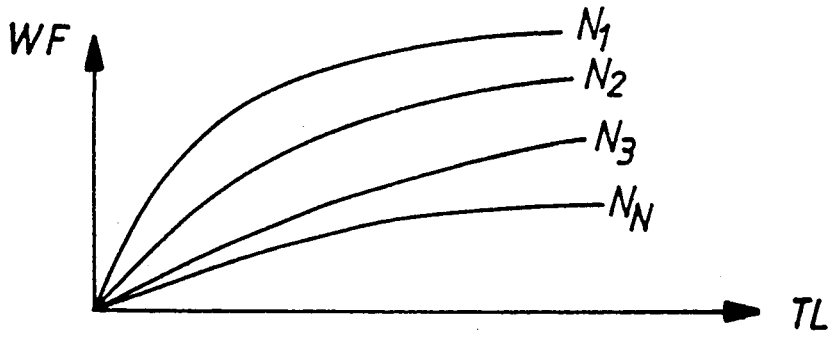
FIGS. 5 to 7 are characteristic curves used to explain the basis of the operating principles of the present invention.

FIG. 5 shows such a characteristic field represented as a family of curves of wall film quantity WF plotted against engine load TL, corresponding respectively to a plurality of actual engine speeds $N_1$, $N_2$, $N_3 \ldots N_N$.

The wall film quantity can thus be expressed as:

$$WF = characteristic\ field\ (TL, N)$$

Figure 6:
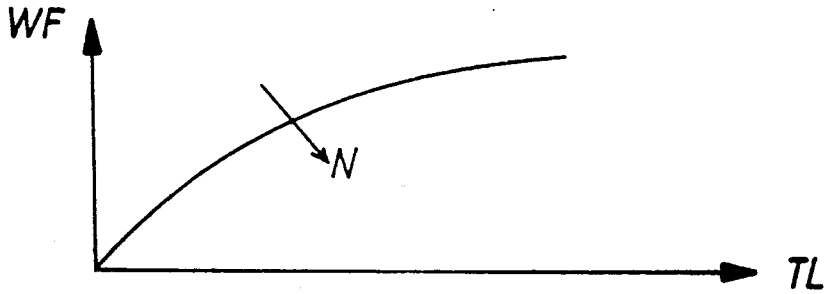

The situation can be simplified by combining the family of curves of the characteristic field in one characteristic curve plotted against load TL (see FIG. 6). The influence of speed can be described by one factor N, the actual speed value.

In this case, the wall film quantity can be expressed as:

$$WF = K_1 \times characteristic\ curve\ (TL) \times (1 - K_2 N)$$

where $K_1$ and $K_2$ are constants.

Figure 7:
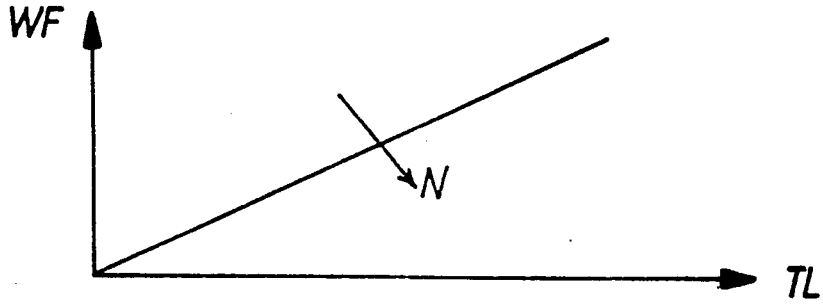

A further simplification can be obtained by assuming a linear relationship between the wall film quantity WF and the load TL, as illustrated in FIG. 7.

The wall film quantity is then given by:

$$WF = K_1 \times TL \times (1 - K_2 N) \quad (1)$$

In the present technique for achieving transition compensation, the latter assumption is made, namely that there is a linear relationship between load and wall film quantity.

Since engine load TL is known to be proportional to the intake manifold pressure p, the instantaneous wall film quantities can be calculated by establishing the relevant manifold pressure p.

In accordance with one aspect of the present technique, the average pressure p(t) is used during static driving conditions to determine the engine load TL but, during engine speed transitions, the average pressure p(t) is replaced by the prevailing peak pressure.

Figure 3:
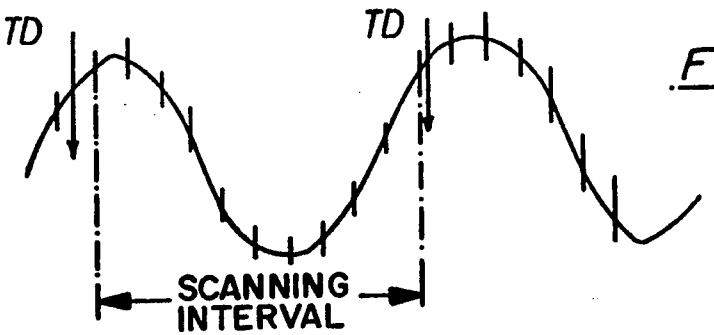
FIG. 3 illustrates diagramatically the pressure in the inlet manifold and how this is scanned for establishing the average pressure.

For the determination of the average pressure value p(t), the curve of the intake manifold pressure is scanned at high frequency by means of a control device program (see FIG. 3). The scanning values are added in a summing register (not shown). Following each complete combustion period (TD), it is checked whether a minimum number of scannings has been reached. If it has not, then the summation is continued to the next complete combustion period (TD). If, however, the minimum has been reached, then the sum of the pressure readings is divided by the number of scannings to provide the average value of the pressure.

Figure 4:
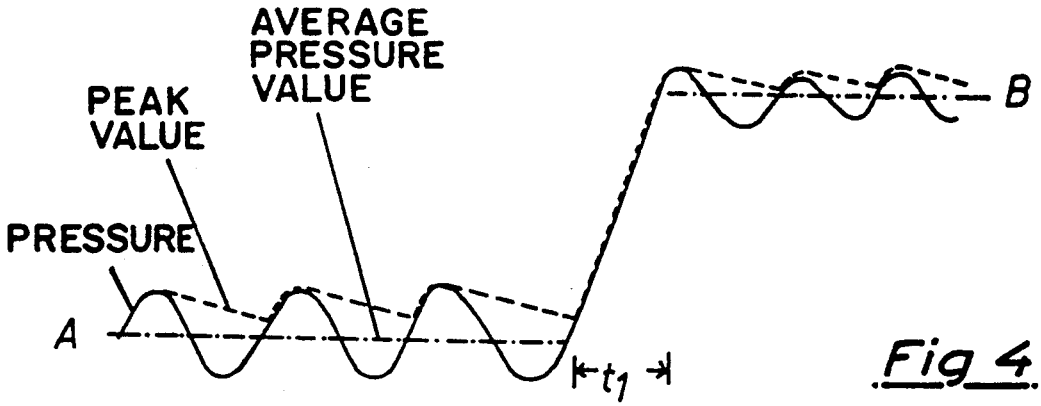
FIG. 4 illustrates diagrammatically the variation in inlet manifold pressure during a transition phase.

Peak value of pressure is calculated by rectification of the pulsing signal of the intake manifold pressure using software (see FIG. 4). The peak value is formed in the time raster of the scanning.

Figure 1:
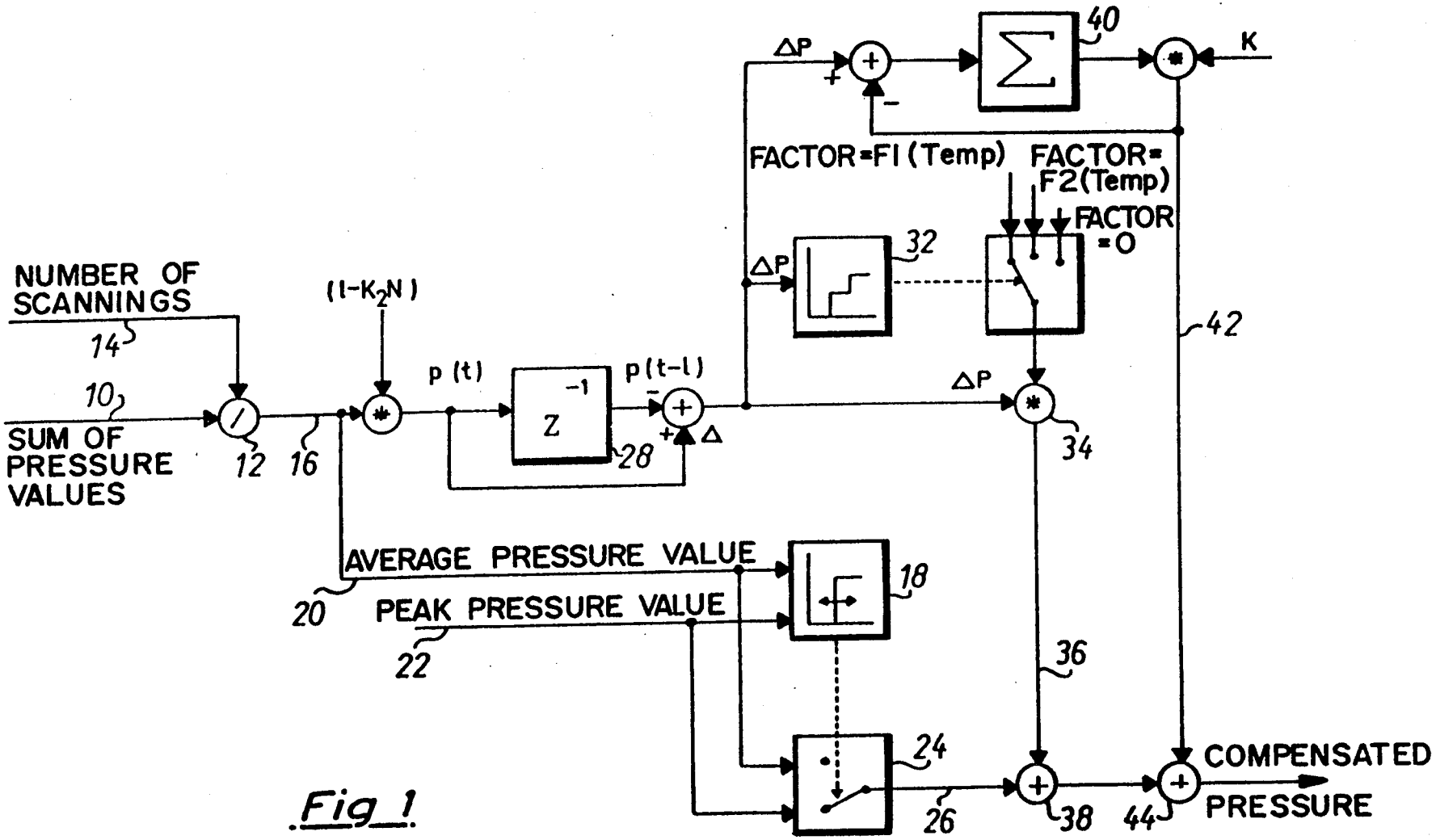
FIG. 1 is a block diagram illustrating part of a control program in accordance with the present invention, involving load calculation.

Referring now to FIG. 1, which shows a first part of a system embodying the present invention, the sum of the scanned pressure values on line 10 is divided at 12 by the number of scannings on line 14 to provide the average pressure on line 16. The latter value is modified to comply with equation (1) by multiplying it by the factor $(1-K_2N)$, where $K_2$ is a constant and N corresponds to the instantaneous actual engine speed. This results in a modified average pressure value p(t) corresponding to the basic desired wall film quantity WF.

The average value p(t) is applied to one input of a comparison device 18 by way of a line 20. A value corresponding to the peak pressure value, as measured above, is applied to a second input of the comparison device 18 by way of a line 22.

At each complete combustion period TD, the peak pressure value on line 22 is compared with the average pressure value on line 20. If the peak value is found to be a certain predetermined threshold above the average pressure value, as will be the case for example during the period $t_1$ in FIG. 4 corresponding to the time of transition between one operating state A and a higher operating state B, then a switch 24 is arranged to be switched over so that the average value previously supplied by way of the switch to a line 26 is replaced by the peak pressure value from line 22. By this means, it is arranged that the most up-to-date load value is used for calculation of the load TL.

In accordance with a further aspect of the present technique, the pressure signal on line 26 is modified to provide transition compensation which takes place with a "quick" component and a "slow" component.

The "quick" component involves modifying the pressure value by different factors when the change in pressure $\Delta p$ exceeds different predetermined thresholds. The pressure difference value $\Delta p$ is obtained by establishing the value $p(t-1)$ in a circuit block 28 and adding the value p(t) in an adder 30. The value of $\Delta p$ is checked against two predetermined thresholds in a threshold device 32. Above the first threshold, $\Delta p$ is boosted by multiplying it, in a multiplier 34, by a factor $F_1$ obtained from a temperature curve. The resulting product on line 36 is used to boost additively the pressure signal on line 26 by way of an adder 38. If the pressure difference $\Delta p$ exceeds a second threshold, then $\Delta p$ is arranged to be multiplied by an alternative, larger, temperature-dependent factor $F_2$. The latter increased quantity is, however, arranged so as to be injected only once during a given kick-down operation. Furthermore, the increased quantity can be discharged in an intermediate operation if the $\Delta p$ jump takes place in an ignition interval in which injection would not normally take place.

The latter threshold strategy enables adaptation to the actual non-linear connection between the wall film quantity and the load to take place.

In order to provide the "slow" component of compensation, the pressure differences $\Delta p$ are added up in a second program path in the background to the primary program path described hereinbefore. This adding up is achieved in a summing register 40 which is regulated down in synchronism with ignition intervals in accordance with an exponential e-function. The summing register 40 provides a memory function. Incoming $\Delta p$ values are added up in the register 40, whose output is modified by a factor K in a multiplying element 43 and is subtracted in an adder 41 from the incoming $\Delta p$ values, whereby the register content is always representative of the residual amount which has not yet been injected. The factor K determines the rate of emptying of the register, since a predetermined portion of the content of the register is delivered with each injection pulse and is thus also subtracted. The regulated value provided on line 42 is interpreted as an additional quantity for injection, inserted by way of an adder 44, and is converted using a standardisation factor into an injection quantity. The $\Delta p$ summing register 40 thus represents a store for the injection duration, which is regulated down with a slow time constant.

Together with the rapid increased injection, the fuel quantity balance is compensated in the event of changes in load when the wall film quantity in the intake manifold is built up or reduced.

Figure 2:
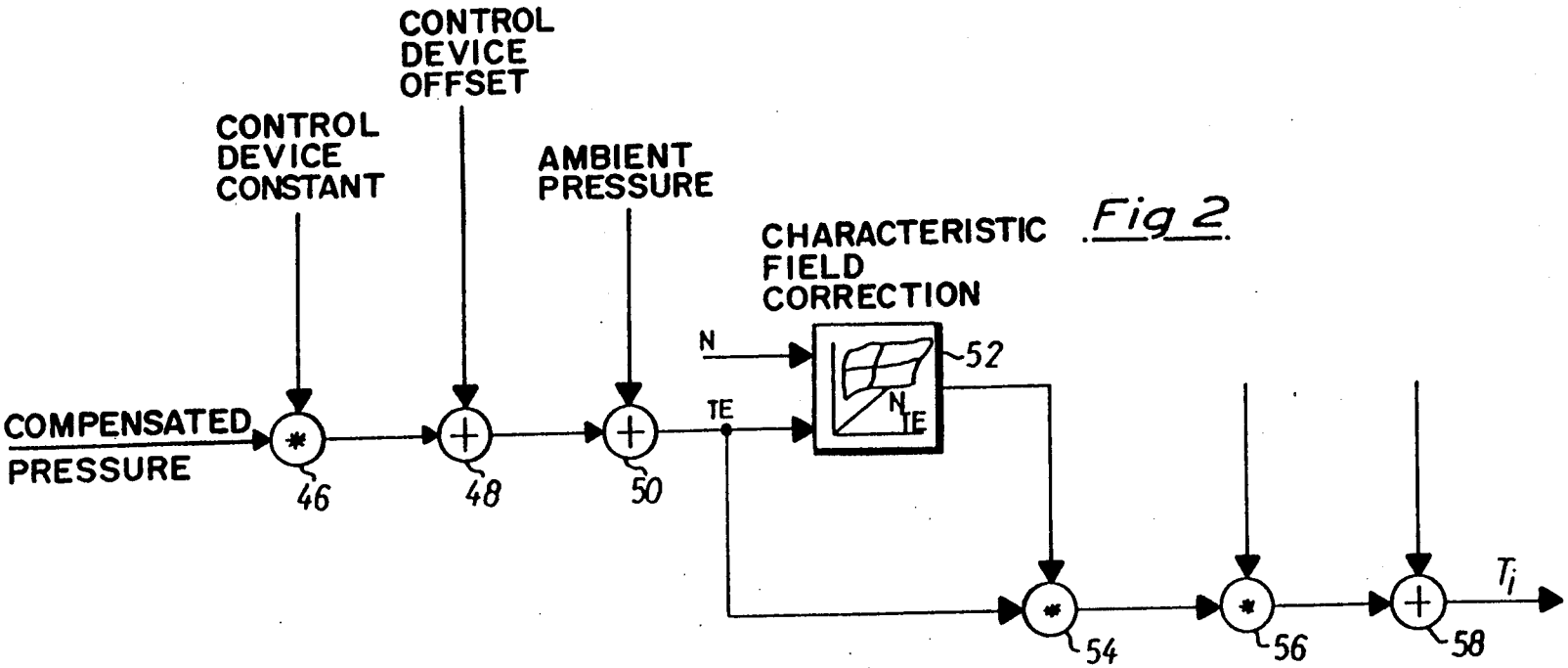
FIG. 2 is a diagram illustrating part of a main control program which operates in synchronism with the engine ignition and is used to calculate the period of injection.

Referring now to FIG. 2, the injection time $T_i$ is established in that the compensated pressure output by the circuitry of FIG. 1 is now multiplied at 46 by a control device constant and the result added at 48 to a control device offset. The "control device constant" is the constant in the relationship between manifold pressure and injection time and depends in practice on the particular injection valve used. The "control device offset" is a basic additive correction in the relationship between manifold pressure and injection time. The influence of ambient pressure is taken into account at 50.

Multiplicative correction is also made at 54 dependent upon (a) characteristic field correction 52, and at 56 dependent upon (b) warming up of the engine, (c) restarting of the engine, (d) pump voltage correction and (e) intake air correction. Additive correction is made at 58 dependent upon valve voltage level.

Since the injection period $T_i$ must be calculated in a time-critical program section with the load information from the completed ignition (TD) period, the slowly changeable parameters are calculated in the background program and combined and transmitted to the rapid program level.

Thus, a system is provided wherein pressure differences Δp are used, following restandardisation into an injection quantity, to provide an effective means for transition compensation. This technique acts symmetrically both during acceleration enrichment as well as during leaning out or deceleration. The number of application parameters is limited, and they can be simply adapted. A further advantage is that the method compensates leaning-out through the entire characteristic field range.

It should be noted, however, that the invention is limited in the case of very rapid gas surges or in the case of gas surges which are triggered when the throttle valve is already almost fully open. In this case, it is necessary also to evaluate and take into account the throttle valve potentiometer position, particularly in single-point injection systems.

We claim:

1. A fuel injection system for an internal combustion engine wherein the lengths of fuel injection pulses (ti) are based on engine load signals (TL) developed from a measurement of intake manifold pressure (p), the system comprising:

means for providing compensation for the fuel injection signals during transitions between different dynamic operating conditions by modifying the actual inlet manifold pressure value to provide fast acting transition compensation;

first adding means for adding a first compensation value to said actual inlet manifold pressure value depending on a difference of a previously measured pressure value and an actual value; and, second adding means for adding a second compensation value to said actual inlet manifold pressure value depending on the running summation value of said pressure difference values governed down by a time constant.

2. The fuel injection system of claim 1, wherein the pressure difference values (Δp) are modified by other engine-dependent factors when the measured incremental inlet manifold pressure differences (Δp) exceed predetermined thresholds.

3. The fuel injection system of claim 2, wherein said other engine operation-dependent factors involve engine-operating temperature.

4. The fuel injection system of claim 3, wherein above a first threshold of pressure difference (Δp), the pressure value (p) is modified additively in accordance with the pressure difference (Δp); and, said pressure difference (Δp) being modified by a first engine temperature-dependent factor (F1).

5. The fuel injection system of claim 4, wherein above a second threshold of pressure difference (Δp), the pressure difference (Δp) is modified by a second, larger engine temperature-dependent factor (F2).

6. The fuel injection system of claim 1, wherein both the average value of the inlet manifold pressure over a complete combustion period and the rectified peak value of the inlet manifold pressure over a complete combustion period are established, and wherein, when the peak value exceeds the average value by more than a predetermined threshold, the average value is replaced by the peak value to provide the pressure values modified in dependence upon the incremental pressure difference values (Δp) to provide transition compensation.

7. The fuel injection system of claim 1, wherein the inlet manifold pressure values are multiplied by the factor $(1-K_2N)$, where $K_2$ is a constant and N corresponds to the instantaneous actual engine speed, in order to provide a modified pressure value p(t) corresponding to a desired wall film quantity.

* * * * *